US009796109B2

(12) United States Patent
Floreani et al.

(10) Patent No.: US 9,796,109 B2
(45) Date of Patent: Oct. 24, 2017

(54) MODULAR BUILDING CONSTRUCTION ARRANGEMENT

(71) Applicant: Emoljac Investments Pty Ltd. as trustee for Floreani Nominees, Gisborne (AU)

(72) Inventors: Paul A. Floreani, Kensington (AU); Leo T. Floreani, Kensington (AU)

(73) Assignee: Emoljac Investments Pty Ltd. as Trustee for Floreani Nominees, Victoria (AU)

( * ) Notice: Subject to any disclaimer, the term of this patent is extended or adjusted under 35 U.S.C. 154(b) by 0 days.

(21) Appl. No.: 14/560,608

(22) Filed: Dec. 4, 2014

(65) Prior Publication Data

US 2015/0083889 A1 Mar. 26, 2015

Related U.S. Application Data

(63) Continuation of application No. 13/796,026, filed on Mar. 12, 2013, now abandoned, which is a (Continued)

(30) Foreign Application Priority Data

Feb. 10, 2009 (AU) ..... 2009900521

(51) Int. Cl.
*B28B 7/22* (2006.01)
*B28B 7/30* (2006.01)
(Continued)

(52) U.S. Cl.
CPC ..... *B28B 7/22* (2013.01); *B28B 7/0002* (2013.01); *B28B 7/30* (2013.01); *E04G 11/02* (2013.01)

(58) Field of Classification Search
CPC .. E04G 11/02; B28B 7/22; B28B 7/30; B28B 7/0002
(Continued)

(56) References Cited

U.S. PATENT DOCUMENTS 4,447,035 A * 5/1984 Ivey ..... B28B 7/30 249/180
4,570,896 A * 2/1986 Strickland ..... E04G 11/082 249/152
(Continued)

FOREIGN PATENT DOCUMENTS

AU 9744439 * 10/1997 ..... B28B 7/00
DE 3400322 A1 * 6/1985 ..... B28B 7/22

*Primary Examiner* — Alison L Hindenlang
*Assistant Examiner* — Emmanuel S Luk
(74) *Attorney, Agent, or Firm* — Fox Rothschild LLP

(57) ABSTRACT

This invention relates to modular building construction apparatus and in particular to a mold having movable framework used to construct a basic building module where any miss-alignment at the junction of framework elements is enough to make the imperfection noticeable. If the imperfection is a ridge it will be readily apparent on the inside surface of the formed building module and it will not be disguised by painting over it. What is disclosed is a movable corner arrangement for a mold for forming at least one of the inner corner surfaces of a moldable building module. The inner mold for a moldable building module has an upper support panel for forming the ceiling surface of the building module and a plurality of movable side walls that depend from the upper support panel using flexible peripheral edge elements. The side walls have mold facing side wall surfaces movable to a position to form corresponding internal wall surfaces of the moldable building module. The movable side walls are movable inwards and away from their respective formed internal wall surfaces to release the formed building module from the inner mold. A movable corner arrangement is used to form the internal corners of the moldable building module located between adjacent movable side walls. The movable corner arrangement includes a corner post having at least one side wall abutment surface; a corner post support coupling adapted to adjust the vertical and sideways position
(Continued)

of, and verticality of the corner post with respect to the desired position of adjacent movable side walls such that the mold facing surface of the corner post is flush with the mold facing surface of respective adjacent movable side walls during the molding process.

7 Claims, 8 Drawing Sheets

Related U.S. Application Data continuation of application No. 13/148,502, filed as application No. PCT/AU2010/000123 on Feb. 5, 2010, now abandoned.

(51) Int. Cl.
*E04G 11/02* (2006.01)
*B28B 7/00* (2006.01)

(58) Field of Classification Search
USPC ..... 249/27, 39, 139, 149, 152, 162–163, 249/177–178, 180, 182, 184–186, 194
See application file for complete search history.

(56) References Cited

U.S. PATENT DOCUMENTS 4,624,440 A * 11/1986 Buchler ..... E01D 21/00 249/159
5,269,633 A * 12/1993 Cornelis de Roo .... E04G 11/02 405/146

* cited by examiner

MODULAR BUILDING CONSTRUCTION ARRANGEMENT

CROSS-REFERENCE TO RELATED APPLICATIONS

This application is a Continuation of U.S. application Ser. No. 13/796,026, filed Mar. 12, 2013, now abandoned, which is a Continuation of U.S. application Ser. No. 13/148,502 filed on Sep. 28, 2011, now abandoned, which is a National Phase application under 35 U.S.C. §371 of International Application Serial No. PCT/AU2010/000123, filed Feb. 5, 2010, which claims priority to Australian Patent Application No. 2009900521 filed Feb. 10, 2009, the disclosures of which are incorporated by reference.

This invention relates to modular building construction apparatus and in particular to a mould used to construct a basic building module.

BACKGROUND

The invention described herein is a modification and improvement of Australian Patent No. 741667 in the name of the present applicant. The AU741667 patent specification in its entirety is incorporated by reference herein.

A problem of the invention disclosed in AU741667 is that even though the corners and side wall surfaces are movable and settable into position it is possible for them to be misaligned during the moulding process. Where the surfaces interface is the region that is most susceptible to relative movement primarily because of the pressure of the settable material (typically standard or fibre reinforced concrete) along the length of those interfaces but becoming greater at the bottom of the mould. Any misalignment at the interface of the movable parts of the mould will result in there being a surface imperfection in the formed building module. Such imperfections are more likely to occur in association with the internal movable mould panels and thus be noticeable on the inside of the building module. A less than 1 mm misalignment is enough to make the imperfection noticeable.

If the imperfection is a ridge it will be readily apparent on the inside surface of the formed building module and it will not be disguised by painting over it. It needs to be smoothed out and that process is a labour intensive and ultimately expensive process, which also unnecessarily increases the time to manufacture each building module. As there are eight such interfaces (two per corner) there are potentially eight ridges to smooth out per building module.

BRIEF DESCRIPTION OF THE INVENTION

In a broad aspect of the invention a movable corner arrangement for a mould for forming at least one of the inner corner surfaces of a mouldable building module, the inner mould for a mouldable building module having an upper support panel for forming the ceiling surface of the building module and a plurality of movable side walls that depend from the upper support panel using flexible peripheral edge elements the side walls having mould facing side wall surfaces movable to a position to form corresponding internal wall surfaces of the mouldable building module and wherein the movable side walls are movable inwards and away from their respective formed internal wall surfaces to release the formed building module from the inner mould, wherein a movable corner arrangement is used to form the internal corners of the mouldable building module located between adjacent movable side walls, the movable corner arrangement includes:

- a corner post having at least two side wall abutment surfaces;
- a corner post support coupling fixed relative to the upper support panel and adapted to adjust, the vertical and sideways position of, and verticality of, the corner post with respect to the position of adjacent movable side walls such that the mould facing surface of the corner post is flush with the mould facing surface of respective adjacent movable side walls during the moulding process while the side wall abutment surface abuts a respective side wall.

In a preferred arrangement the movable corner arrangement for a mould for forming a mouldable building module has a flexible peripheral edge element connecting the upper support panels to each respective movable side wall, the movable corner arrangement further including:

- a curved top surface adapter plate located on top of the corner post having at least two stepped side wall abutment surfaces wherein to adjust the vertical and sideways position of, and verticality of the corner post with respect to the desired position of adjacent movable side walls is such that the mould facing surface of the curved top surface adapter is made flush at the outer surface with the adjacent flexible peripheral edge element.

A detailed description of one or more preferred embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications, and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

The reference to any prior art in this specification is not, and should not be taken as, an acknowledgment or any form of suggestion that such prior art forms part of the common general knowledge.

DETAILED DESCRIPTION OF AN EMBODIMENT OF THE INVENTION

Figure 1:
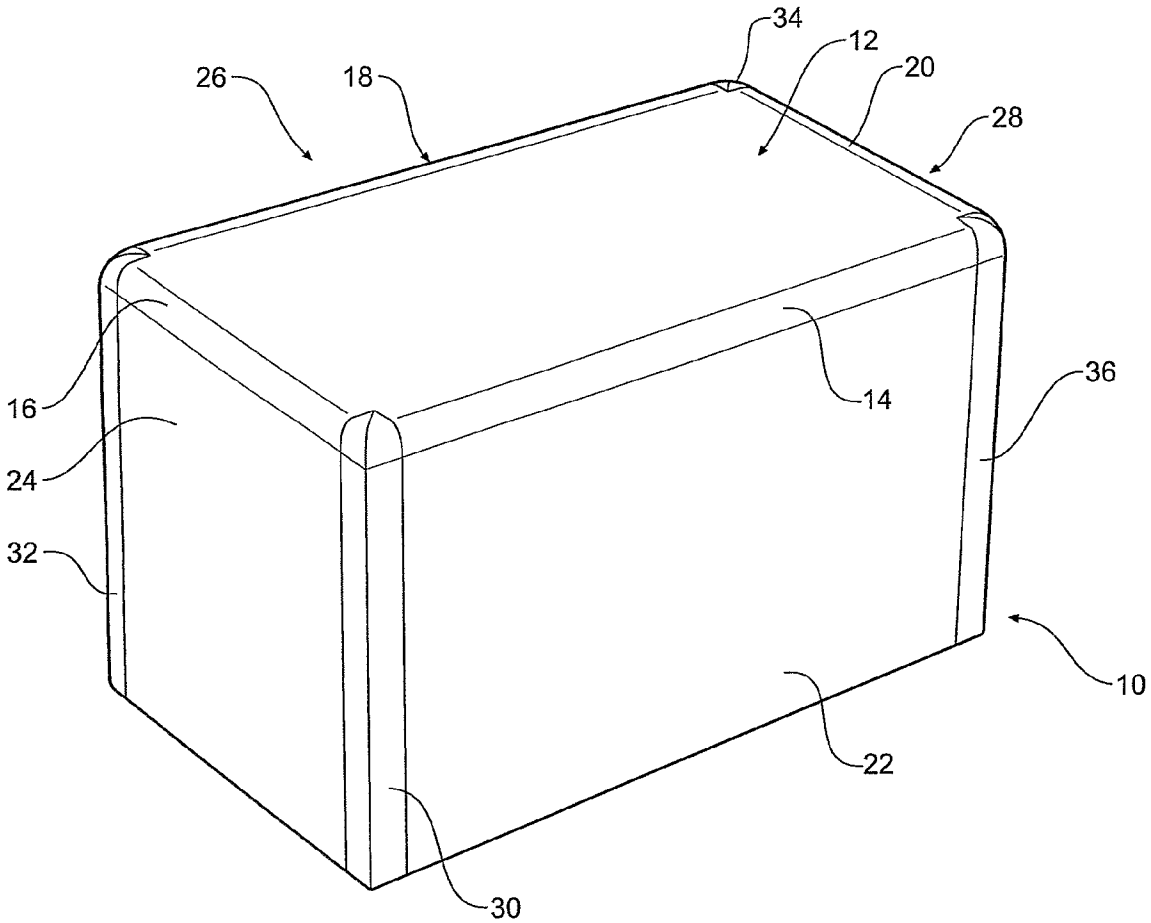
FIG. 1 depicts a perspective view of an inner mould assembly.

FIG. 1 depicts an external perspective view of an inner mould formwork suitable for forming the internal wall shape of a unitary substantially rectangular building module.

The inner mould assembly 10 comprises a planar upper support panel 12 (which forms the internal ceiling of the formed building module) having flexible peripheral edge elements 14, 16, 18 and 20; movable side wall panels 22 to 24 (26 and 28 not shown); and movable corner arrangements 30, 32, 34 and 36. Each wall panel 22, 24, 26 and 28 is movable and is arranged, in one preferable embodiment, to depend along with a respective flexible edge element 14, 16, 18 and 20 from the upper support panel and move inwards of the inner mould to release the mould from the formed building module.

Like numerals are used to identify like elements in all the figures.

The internal elements of the movable formwork as well as the supporting frameworks may be constructed of timber however for structural longevity and repeatable accuracy of adjustment, steel is preferred.

The external wall surfaces of the mould can be made of various materials which will impart a characteristic surface texture (preferably sheet metal so as to provide a smooth surface on the inner surface of the formed building module) or the top and side walls of the outer portion of the mould can be covered with material which will provide a predetermined texture to the internal surface of the formed building module. The same applies to the surfaces of the mould that form the external surfaces of the formed building module.

Each corner arrangement of the inner mould formwork is movable so that it can be set into position to form the internal corners of the formed building module. To simplify the description only movable corner arrangement 32 will be described in detail but it will be understood that movable corner arrangements 30, 34 and 36 are the same.

Figure 2:
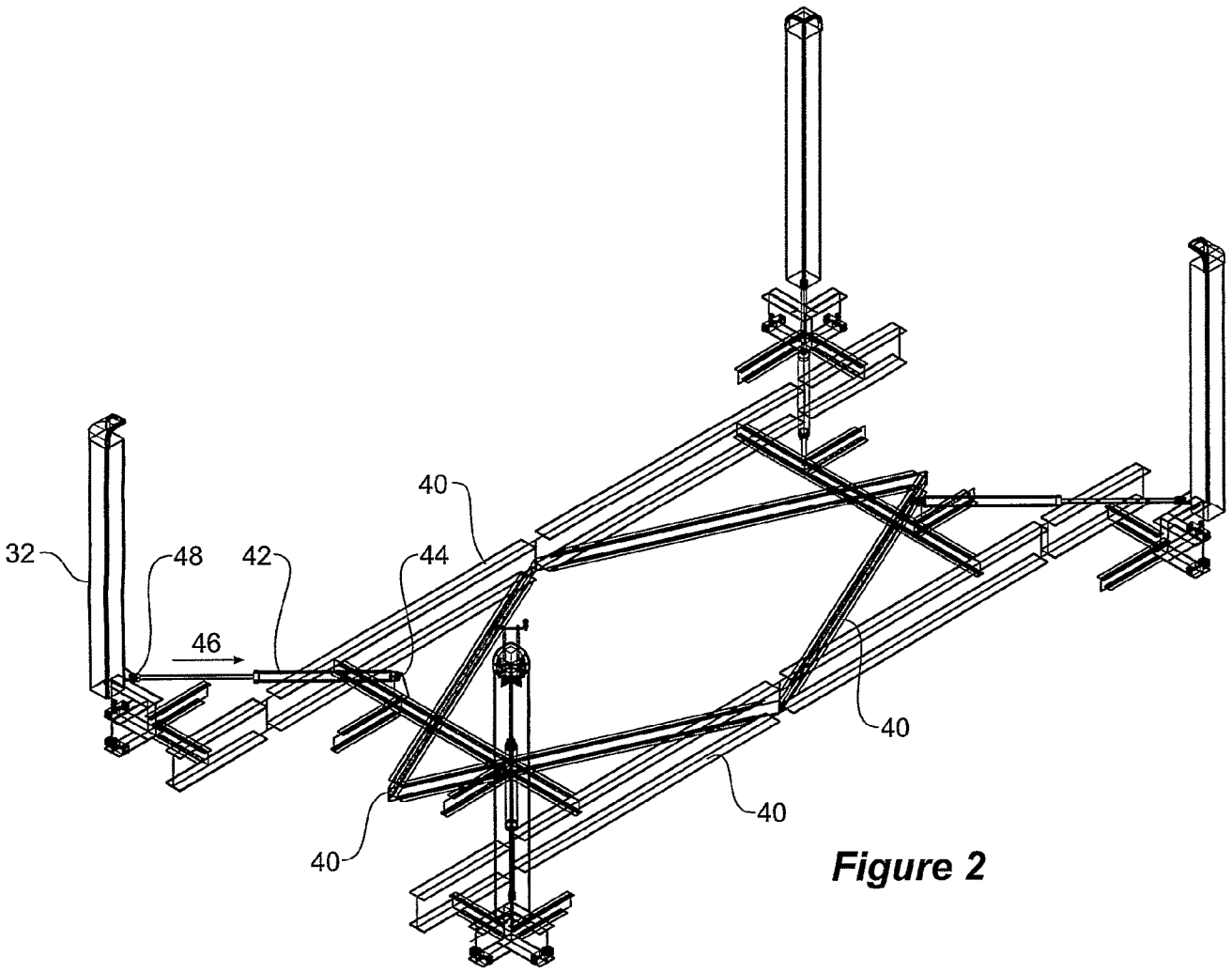
FIG. 2 depicts a perspective view of four corner post arrangements located on a base framework.

FIG. 2 depicts the base framework 40 (details of which are not relevant to the embodiment described herein) to which one end of a ram 42 (preferably hydraulically operated) is pivotally fixed 44 to the frame, so that operation of the ram draws (inward (with respect to the base framework) as shown by arrow 46) the lower end of a respective corner post (to which the ram is also pivotally fixed 48) towards the fixing point on the base framework. Not shown on the corner post in FIG. 2 is a corner post coupling adapted to pivot the corner post downward and inward at the upper end of the corner post as is shown in detail in FIGS. 4-7 and described in greater detail in this specification.

Figure 3:
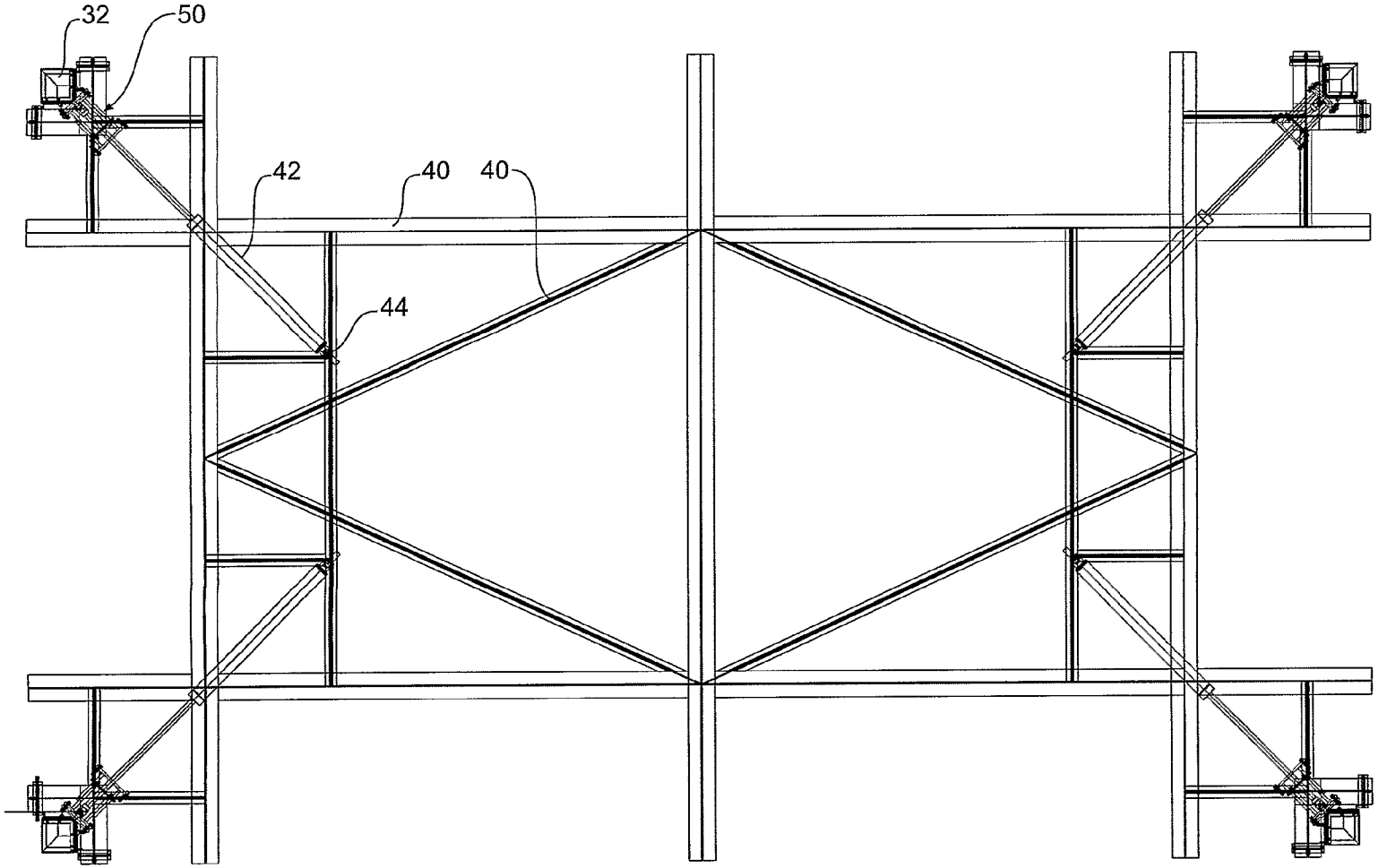
FIG. 3 depicts a top view of FIG. 2.

FIG. 3 depicts a top view of FIG. 2 and partially depicts the corner post coupling 50 mentioned previously with the base framework 40 below. The ram 42 and pivotal fixing point 44 are shown as is a corner post coupling 50 in relation the base frame 40 and the post of the corner arrangement 32.

Figure 4A:
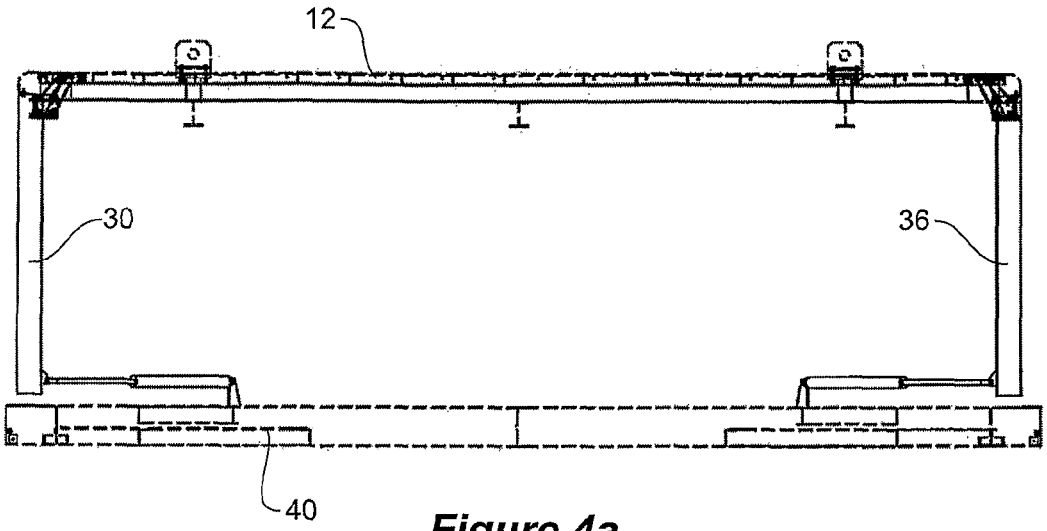
FIGS. 4*a* and 4*b* each depict a side view of two of the corner posts in relation to the base framework and an upper support panel.
Figure 4B:
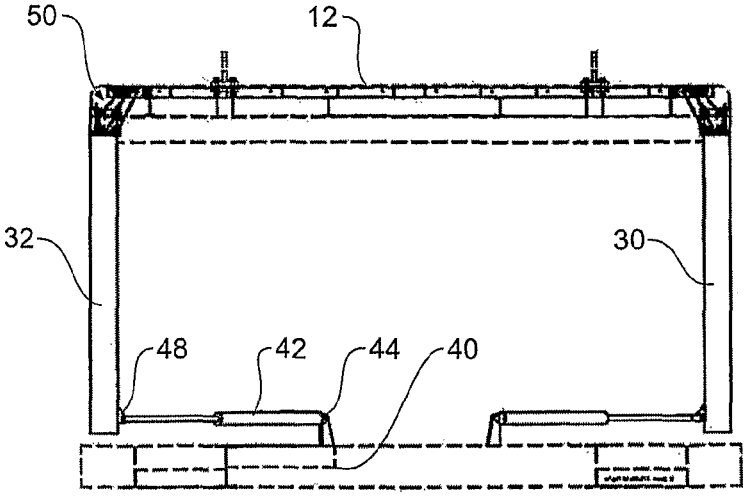
Figure 8:
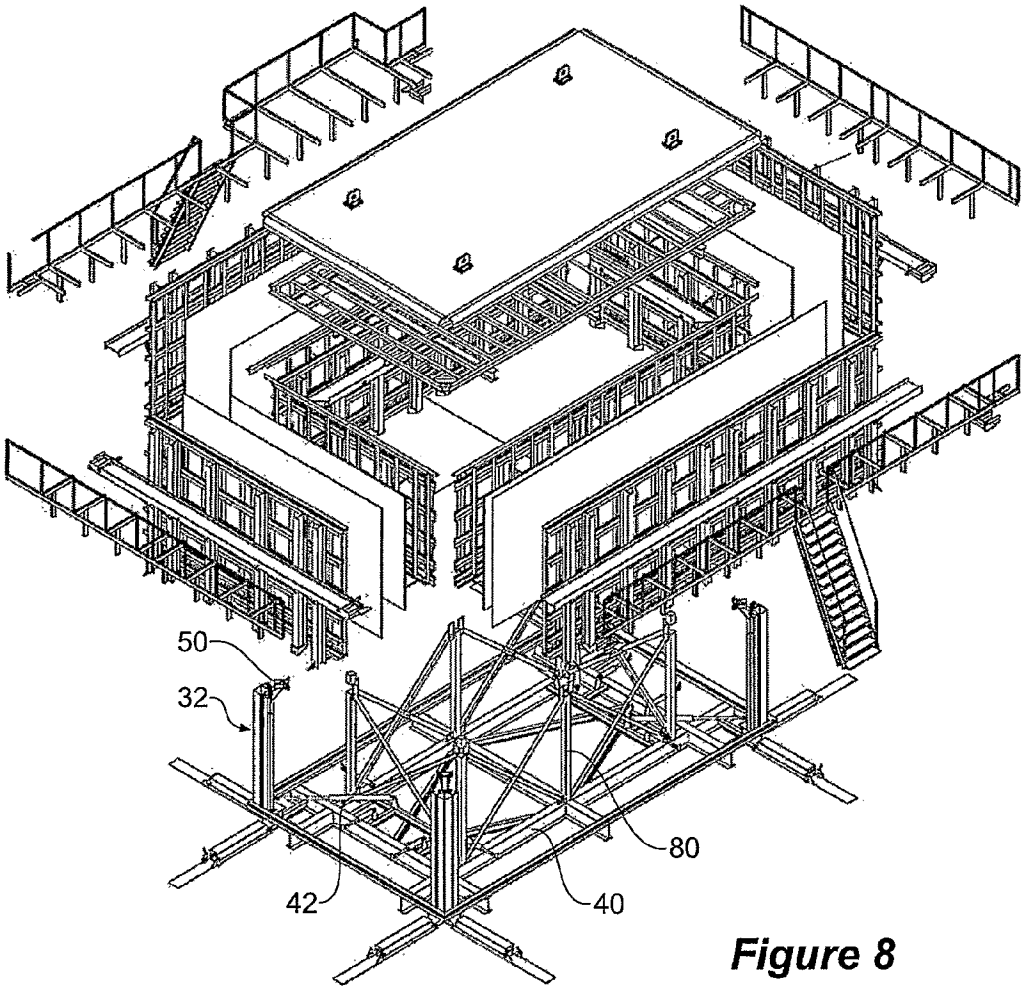
FIG. 8 depicts the elements of FIG. 2 as well as the framework for supporting both the internal and external mould elements and working platforms provided about the mould assembly to allow workers access to pour the settable material into the prepared mould.

FIGS. 4*a* and 4*b* each depict a side view of two of the corner posts in relation to the base framework 40 and an upper support panel 12 which is fixed to and with respect to framework (not shown in this figure but depicted in one form in FIG. 8). The upper support panel needs to be supported from below so as to withstand the weight of the settable material over its whole surface and ideally maintain a planar surface which will be the internal ceiling of the formed building module. As mentioned above, support frame members extend up from the base framework to support the upper support panel 12, which are not shown in FIG. 4*a* or FIG. 4*b* but shown in FIG. 8 without the upper support panel 12 to obscure the view of the support members.

Figure 5A:
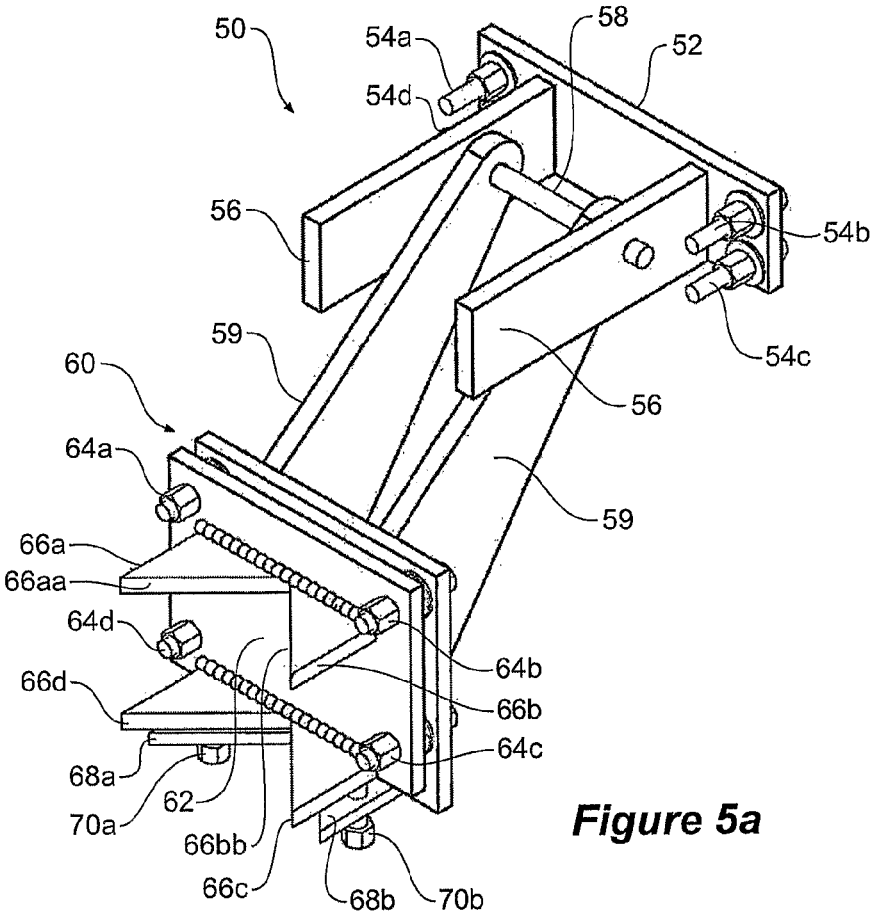
FIG. 5*a* depicts a perspective view of a corner support coupling.
Figure 5B:
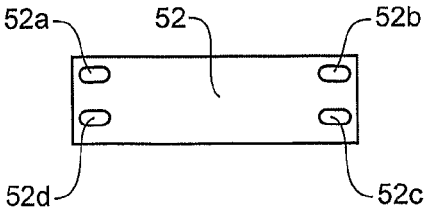
FIG. 5*b* depicts a side elevation view of a corner support coupling plate for adjusting the sideways position of the corner post.
Figure 5C:
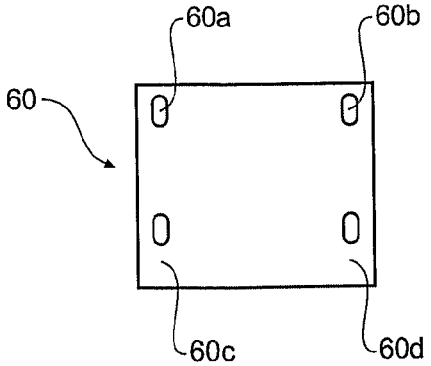
FIG. 5*c* depicts a side elevation view of a corner support coupling plate for adjusting the vertical position of the corner post.

A detailed view of one embodiment of a corner post coupling 50 is depicted in FIG. 5*a*. In this embodiment the corner post coupling provides the ability for the position of the corner post to be fixed with respect to the frame and hence to upper support panel. There are at least three axes of motion provided by the coupling, allowing the corner post to be adjusted horizontally (translate sideways and vertically up and down with respect to the base framework) and adjust the verticality of the corner post. Thus the corner post support coupling 50 is fixed relative to the upper support panel and adapted to adjust, the vertical and sideways position of, and verticality of, the corner post with respect to the position of adjacent movable side walls, such that the mould facing surface 102 (FIGS. 6*c* and 6*d*) of the corner post is flush with the mould facing surface of respective adjacent movable side walls 110 (FIGS. 6*c* and 6*d*) during the moulding process while the side wall abutment surface abuts a respective side wall.

In this embodiment the corner post coupling uses a number of paired plates (plates fixed to the framework and plates fixed to the corner post (one or the other slotted)) with bolts and nuts to fix those paired plates relative one to the other, once the desired location of the paired plates relative to one another is determined. Since the corner post is positioned relative to one another of these plates, it is the location of the corner post with respect to the adjacent side wall that is being controlled. The corner post support coupling includes at least two pairs of plates, at least one plate of the pair of plates fixed with respect to the upper support panel and a plate of the other pair of plates fixed to the corner post, one or the other of the plates being slotted, with bolts and nuts to fix paired plates relative to one another once the desired location of the paired plates relative to one another is determined.

Plate 52 (also shown in FIG. 5*b*) has a vertical orientation in use and is part of the corner post coupling while bolts 54*a*, 54*b*, 54*c* (and 54*d* not shown), which are in a horizontal orientation in use, are fixed to the base framework. Slots

52*a*, 52*b*, 52*c* and 52*d* in plate 52 locate over respective bolts and the orientation of the slots allows the corner post coupling to translate in the horizontal plane, namely from side to side relative to the framework.

Two support plates 56 are fixed to and extend horizontally outwards from plate 52, and between the support plates is fitted a rod 58 at right angles to each support plate. The rod pivotally connects the apex of two triangular plates 59 which depend from the rod and which are connected at the non-pivoting end of the triangular plates to plate 60 (also shown in FIG. 5*c*) which has a substantially vertical orientation (in use) which is also part of the corner post coupling. Plate 60 has slots 60*a*, 60*b*, 60*c* and 60*d* which locate over respective bolts 64*a*, 64*b*, 64*c* and 64*d* which project from plate 62, and the orientation of the slots in plate 60 allows the corner post (which is connected to plate 62 as will be described) to be translated up and down (that is vertically) with respect to the framework.

Triangular projections 66*a* and 66*b* from plate 62 provide two adjacent surfaces 66*aa* and 66*bb* that are shaped to abut two side walls of the corner post (not shown), as also do triangular projections 66*c* and 66*d* spaced from and below the triangular projections 66*a* and 66*b* which also project from plate 62. This arrangement provides the ability for the corner support coupling to engage the corner post at two positions spaced apart vertically. The preferred way of fixing them together is by welding (not shown).

The bolts 64*a*, 64*b*, 64*c* and 64*d* are located in apertures in plate 62 and spacing washers are located between the plates 60 and 62 with nuts associated with respective bolts used to tighten the connection of the two plates and the position of each plate with respect to the other, but only after the vertical position of the corner post is set. The setting of the vertical position is achieved in this embodiment by using two additional triangular projections 68*a* and 68*b* from the lower portion of plate 60. Bolts 70*a* and 70*b* are threaded through respective triangular projections 68*a* and 68*b* and the free ends of the bolts rest upon the underside surface of projections 66*c* and 66*d*. By turning the bolts in their thread in the triangular projections 68*a* and 68*b* the plate 62 is raised or lowered with respect to the corner support coupling 50 thus raising and lowering the corner post with respect to the framework. If one bolt is threaded more or less than the other then the verticality of the corner post is adjusted as well. Using the described arrangement provides for very fine adjustment of the verticality and appropriate choice of the thread will determine the ease and precision of the adjustment.

Figure 6A:
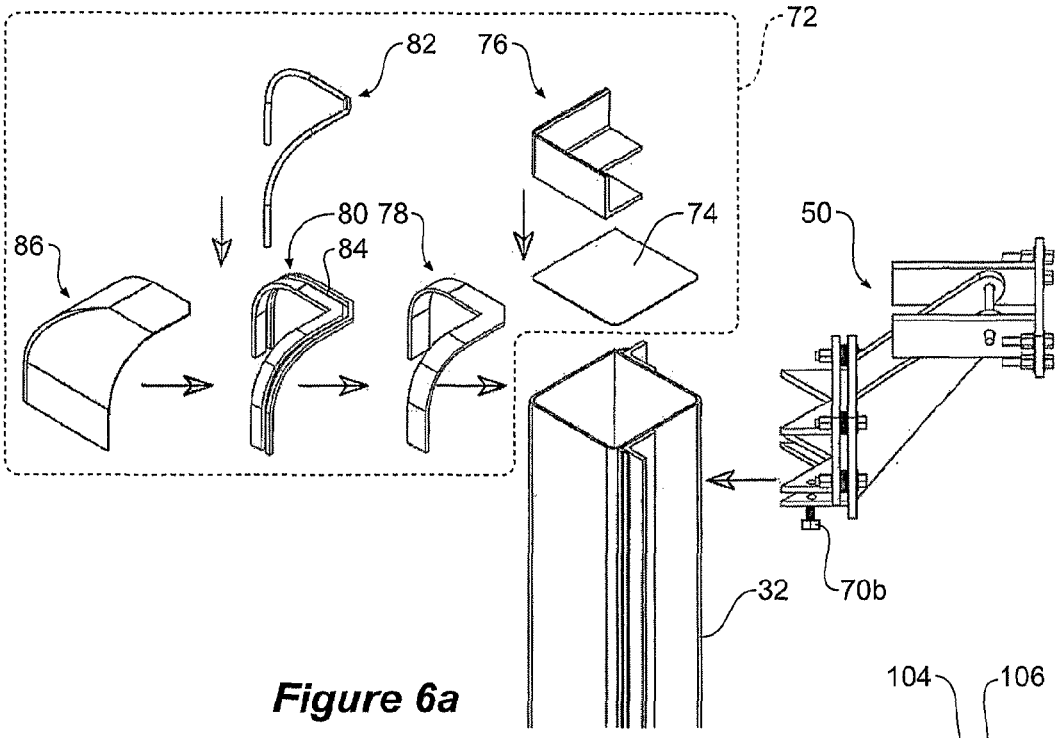
FIG. 6*a* depicts a perspective view of the corner post, associated curved top surface adapter plate (exploded view) and the corner support coupling before they are fixed to each other.
Figure 6B:
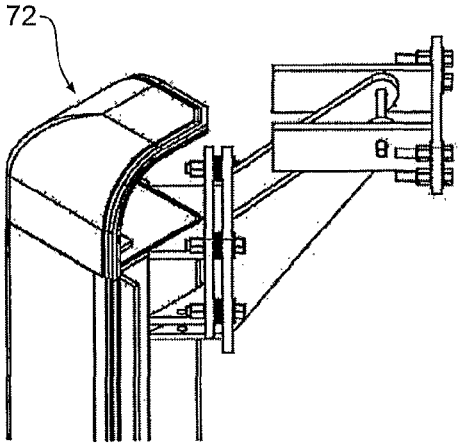
FIG. 6*b* depicts a perspective view of a completely assembled curved top surface adapter plate assembly.

FIG. 6*a* depicts a perspective view of the corner post 32 (although note that the corner post assembly is also referred to as item 32), associated curved top surface adapter plate assembly, the parts of which are depicted within the dotted lines 72, and the corner support coupling 50 before they are fixed to each other. The curved top surface adapter plate assembly 72 includes a number of parts, namely the corner post cap end 74, cap end frame 76, over which is placed the curved plate 78, the brace plate 80, the elastomeric seal 82 which is fitted into the groove 84 in the brace plate 80 and the cover 86. A completely assembled curved top surface adapter plate assembly 72 is depicted in FIG. 6*b*.

There are four corner posts and associated curved top surface adapter plates and four side walls plus the planar upper support panel 12 that form the interior mould. Not shown in the figures is the arrangement for moving each wall panel 22, 24, 26 and 28 which depend along with a respective flexible edge element 14, 16, 18 and 20 and move them inwards of the inner mould to release the mould from the formed building module. The panels are preferably made of sheet steel and their edges are accurately cut to form rectangles that if placed adjacent each other in vertical orientation would form a right angle to each other and form a right angled rectangular shape in plan view. However, these panels are pivotally connected to the planar upper support panel and will depend from the edge of panel 12 to form the rectangular side walls of the mould spaced from each other at four corners. The following description features only one side of a corner post but it will be clear that the features described will apply to all sides of all the four corner posts. It will be apparent that moulds of less and more sided structures and corresponding movable corner posts are possible.

Figure 6C:
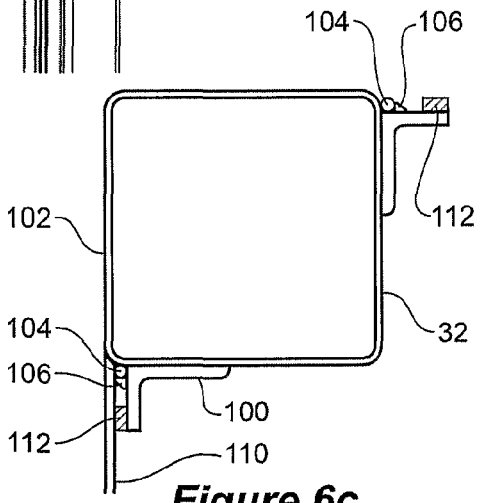
FIG. 6*c* depicts a top view of the corner post abutted by a side panel.
Figure 6D:
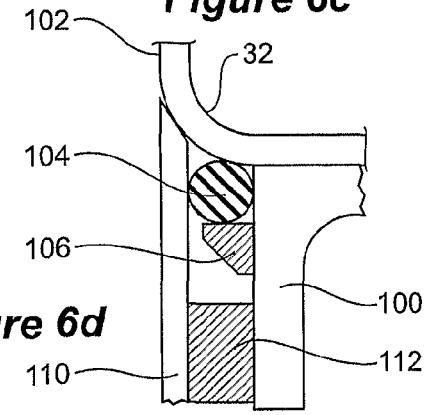
FIG. 6*d* depicts an exploded view of the abutment site of the corner post and side panel.
Figure 7:
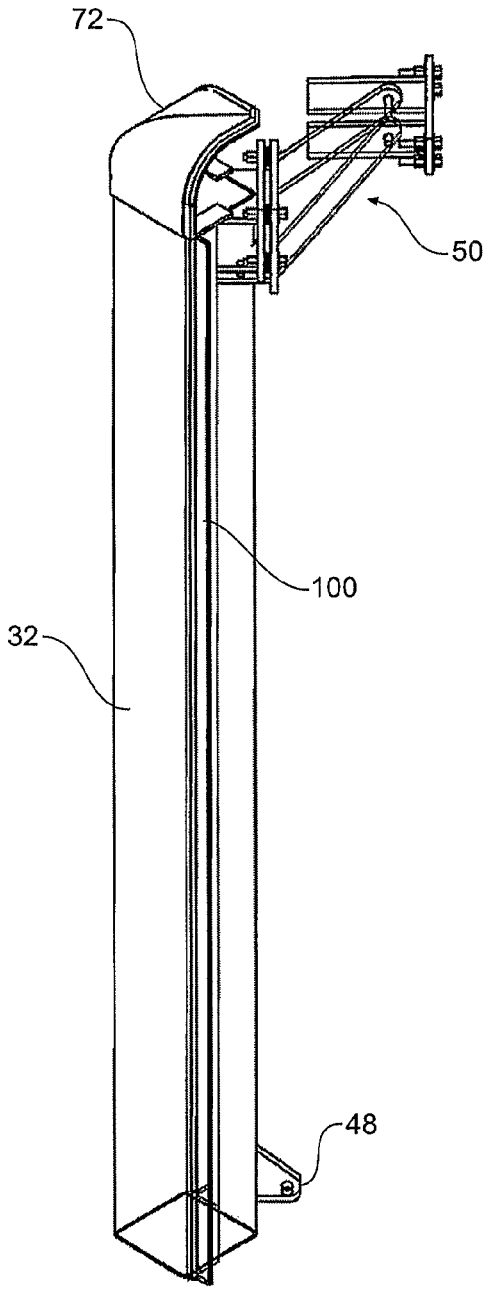
FIG. 7 depicts a perspective view of the elements of FIG. 6 fitted together.

FIG. 6*c* is a top view of the corner post having a right angle brace element 100 and ridge 106 running the full length of the corner post (shown in FIG. 7). The ridge 106 is a preferable element, whereas it would be sufficient to have just a right angle brace element 100 forming a side wall abutment surface. The preferred arrangement described uses the spacing created by using a ridge 106 to confine sealing elements (104 and 112 to be described) to improve the quality of the subject interface between the corner post and adjacent plates. The right angle brace element is shown stepped back from the surface of one side 102 of the corner post the thickness of a side wall panel 110 plus the thickness of the ridge 106, as depicted in FIG. 6*d* showing an exploded view. The abutment site of the corner post and side panel is depicted in FIG. 6*c* where the side wall 110 is held in its final location against spacer 112. In this embodiment the vertical edge of the side wall panel shown in FIG. 1 as 22, 24, 26 or 28 but designated 110 for clarity in this detail, is mitred at an angle (preferably 45 degrees) and between the mitred end and the side of the corner post is preferably an elastomeric seal 104 (preferably a neoprene strip) positioned between the angle brace element 100 and the ridge 106 also running the same length as the brace element 100. The vertical edge of the side wall 110 is mitred regardless of the corner of the corner post being square or round.

The advantage of the use of the brace element is that the outer edge of the side wall panel 110 is supported along its length the full height of the corner post and that when the greatest weight of the flowing settable material is present, the edge of the side wall panel is supported and the edge interface between the side wall panel and the right angled shaped corner of the corner post has little or no reason to separate laterally or vary the otherwise flush outer surfaces of the side wall panel 110 and the surface of one side 102 of a panel. It is the separation and misalignment of surfaces of these two elements that causes imperfections in the visible internal surface of the formed building module.

The same principle applies to the assembly of the corner post associated curved top surface adapter plate assembly 72 which provides a similar brace plate 80 on which the depending flexible edge elements 14, 16, 18 and 20 which are preferably made of sheet steel can rest at their side edges and create a flush outer surface at the abutment of the elements to the cover 86.

FIG. 7 depicts a perspective view of the elements of FIG. 6 fitted together showing in particular the location of the fixing of the corner support coupling 50 to the corner post and the full length of the corner post showing the fixing element 48 of one end of the ram 42 on which that end pivots to allow relative movement while the corner post arrangement is moved, because it also is pivoted at its upper end about rod 58.

FIG. 8 depicts the elements of FIG. 2 as well as the framework for supporting both the internal and external mould elements as depicted by the frame members 80 extending upwardly from the base framework 40. Also depicted but not clearly seen is framework that acts as working platforms about the mould assembly to allow workers access to pour the settable material into the top of the prepared mould, place specific voids, lifting and other services to be formed into the formed building module.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications within its scope.

The invention claimed is:

1. A movable corner arrangement for an inner mould for forming at least one inner corner surface of a mouldable building module, the inner mould having an upper support panel for forming a ceiling surface of the mouldable building module and a plurality of movable side walls that depend from the upper support panel using flexible peripheral edge elements, the side walls having mould facing side wall surfaces movable to a position to form internal wall surfaces of the mouldable building module and wherein the movable side walls are movable inwards and away from the internal wall surfaces after formation thereof to release the formed building module from the inner mould, wherein the movable corner arrangement is located between adjacent ones of the movable side walls, the movable corner arrangement includes:

a corner post having at least two side wall abutment surfaces and a mould facing surface;

a corner post support coupling comprising:

a plate configured to fix relative to an upper support panel, a post fixing means for fixing relative to the corner post and adjusting verticality of the corner post, and a connecting member having a first and second end, the connecting member pivotally connecting the plate at the first end and connecting the post fixing means at the second end, whereby the corner post support coupling is adapted to adjust, the vertical and sideways position of, and verticality of, the corner post with respect to the position of adjacent movable side walls to adjust the mould facing surface of the corner post to be flush with the mould facing side wall surface of respective adjacent movable side walls during a moulding process while each side wall abutment surface of the corner post abuts a respective side wall.

2. The movable corner arrangement according to claim 1 further including:

a curved top surface adapter plate having a mould facing surface located on top of the corner post having at least two stepped side wall abutment surfaces wherein adjustment of the vertical and sideways position of, and verticality of the corner post with respect to the desired position of adjacent movable side walls adjusts a mould facing surface of the curved top surface adapter plate to be flush at an outer surface with the adjacent flexible peripheral edge element.

3. The movable corner arrangement according to claim 1 wherein the side wall abutment surfaces each have a ridge located at least along a portion of the length of a respective side wall abutment surface wherein the location of the ridge provides a spacing in which one or more sealing elements are located against the corner post.

4. The moveable corner arrangement according to claim 1 wherein the corner post support coupling includes at least two pairs of plates, at least one plate of the pair of plates fixed with respect to the upper support panel and a plate of the other pair of plates fixed to the corner post, one or the other of the plates being slotted, with bolts and nuts to fix paired plates relative to one another once the desired location of the paired plates relative to one another is determined.

5. The movable corner arrangement according to claim 1, wherein the post fixing means comprises:

a front plate configured to fix relative to the corner post, a back plate attaching to the front plate and configured to connect to the connecting member, wherein the front and back plate are configured to move relative to each other; and a first projection extending from the front plate, a second projection extending from the back plate, wherein the second projection defines at least a threaded slot for receiving a bolt, wherein a free end of the bolt touches and moves the first projection of the front plate relative to the back plate when the bolt is turned in the threaded slot.

6. The movable corner arrangement according to claim 5, wherein the first projection of the front plate comprises at least a triangular plate.

7. The movable corner arrangement according to claim 5, wherein the second projection of the back plate comprises at least a triangular plate.

* * * * *